US005669611A

United States Patent [19]

Fedele

[11] Patent Number: 5,669,611

[45] Date of Patent: Sep. 23, 1997

[54] MATHEMATICAL GAME APPARATUS

[76] Inventor: Stephen Fedele, 26425 Redhawk La., Clovis, Calif. 93611

[21] Appl. No.: 688,394

[22] Filed: Jul. 30, 1996

[51] Int. Cl.[6] ..... A63F 9/18

[52] U.S. Cl. ..... 273/431

[58] Field of Search ..... 273/429, 430, 273/431, 432, 153 R, 156, 157 R

[56] References Cited

U.S. PATENT DOCUMENTS

| | | | |
|---|---|---|---|
| 3,394,935 | 7/1968 | Beauchaine | 273/157 R X |
| 3,425,139 | 2/1969 | Smith . | |
| 3,659,851 | 5/1972 | Lang et al. . | |
| 3,844,568 | 10/1974 | Armstrong . | |
| 3,961,793 | 6/1976 | Zanders . | |
| 4,155,556 | 5/1979 | Falcione . | |
| 4,205,850 | 6/1980 | Craig | 273/157 R |
| 4,272,081 | 6/1981 | Broom . | |
| 4,346,897 | 8/1982 | Sisak . | |
| 4,565,374 | 1/1986 | Pak . | |
| 5,083,793 | 1/1992 | Sanford . | |
| 5,314,190 | 5/1994 | Lyons . | |
| 5,405,147 | 4/1995 | Garcia . | |

*Primary Examiner*—William H. Grieb
*Attorney, Agent, or Firm*—Chase & Yakimo

[57] ABSTRACT

A game for enhancing a player's mathematical skills utilizes a first deck of question cards posing mathematical problems, the answers to said problems being found in the second deck of answer cards. A preselected number of question cards are dealt to each player. Answer cards are then dealt to each player. Upon a question card being revealed, a player having responsive answer card will reveal the same. Upon such revelation a puzzle piece of a plurality of puzzle pieces is awarded. Upon completion of the puzzle a winner is declared. Various methods of game play utilizing the question and answer cards for awarding puzzle pieces for assembly may be performed.

20 Claims, 4 Drawing Sheets

Front

Back

MATHEMATICAL GAME APPARATUS

BACKGROUND OF THE INVENTION

This invention relates to a game apparatus and, more particularly, to a combination card/puzzle game apparatus which motivates children to learn and/or improve mathematical skills.

Various games have been proposed for teaching various educational skills to the player, particularly children. One such patent is U.S. Pat. No. 5,083,793 to Sanford showing a game board for counting and performing other numerical exercises. Therein is also discussed other game patents for increasing the mathematical skills of the player. It can thus be appreciated that various approaches have been proposed to improve the skills of the game players.

Accordingly, in order to further motivate and inspire children to learn and/or improve their mathematical skills, I have invented a game apparatus presenting a plurality of mathematical question and answer cards, along with a plurality of puzzle pieces forming a selected caricature. On the answer cards are numerals in a highly stylized form, the answer cards presenting answers to mathematical questions found on each question card. A preselected number of answer cards are first dealt to each player. Upon a question card being revealed, a player in turn or any player can reveal an answer card held in their hand corresponding to the presented question. If a correct card is revealed, a puzzle piece of a plurality of pieces is awarded to the winning player for assembly. Upon the entire puzzle being assembled by a player, a winner is declared. Various skill levels of questions and answers can be utilized along with various methods of puzzle construction so as to maintain interest of the players.

It is therefore a general object of this invention to provide a game apparatus for increasing the educational skills of a player.

Another object of this invention is to provide a game apparatus, as aforesaid, which is designed to increase the mathematical skills of the player.

Another particular object of this invention is to provide a game, as aforesaid, which is adaptable to the various skill levels of the players.

Still another object of this invention is to provide a game, as aforesaid, involving simultaneous card play and puzzle construction.

A further object of this invention is to provide a game, as aforesaid, which lends itself to various methods of game play.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
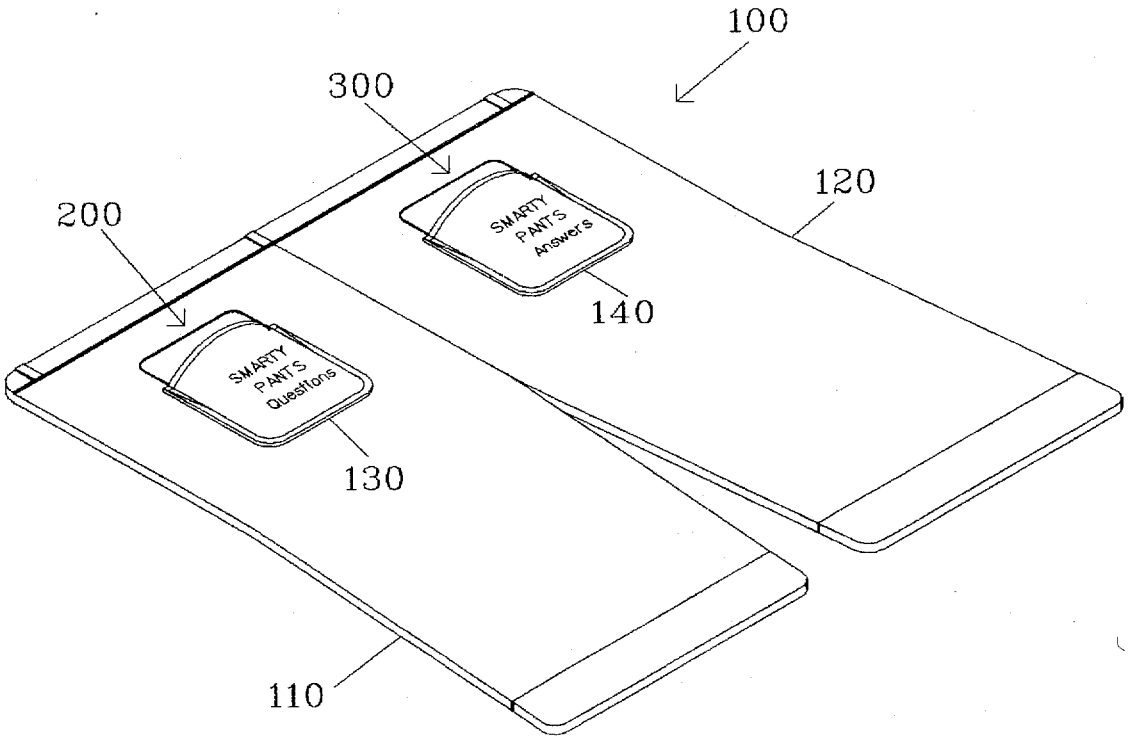
FIG. 1 is a perspective view of one form of the game board as a pair of pants configuration.

Turning more particularly to the drawings, the game board 100 is shown in the configuration of a pair of pants having first 110 and second 120 legs thereon, each leg having a pocket 130, 140 for housing a card deck therein. Although a pants configuration has been chosen so as to complement the "Smarty Pants" trademark 900 by which I intend to identify my game, it is understood that various game board configurations can be utilized. Of course, an alternative playing surface may be utilized if no game board is desired.

Figure 2:
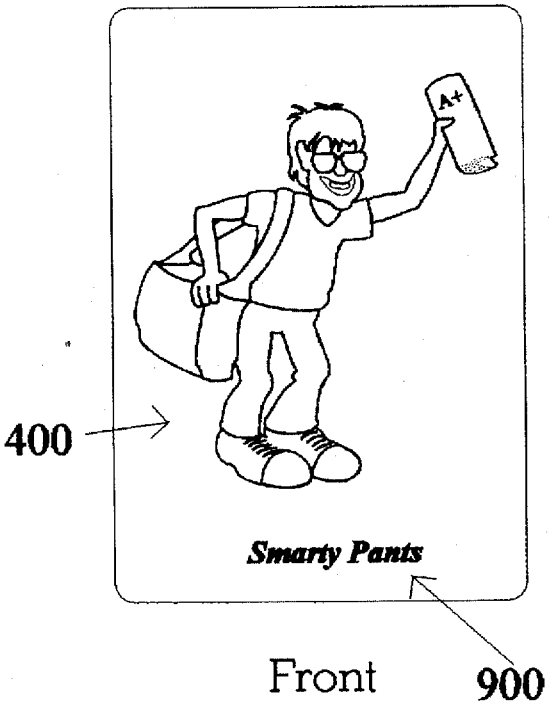
FIG. 2 is a front view of one type of caricature found on the question and answer cards.
Figure 3:
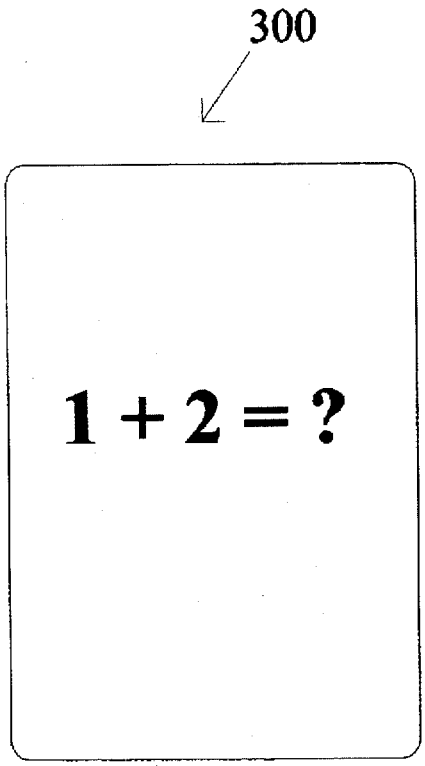
FIG. 3 is a rear view of a question card showing one form of a mathematical question thereon.

Releasably insertable into each pocket 130, 140 is a deck of question cards 200, one card being shown in FIG. 3. Each question card 200 has a caricature 400 on one side of the card (FIG. 2) with various mathematical questions being posed on the other side of the card, e.g. shown in FIG. 3. It is understood that the mathematical solutions, i.e. answers, are not given on these particular question cards 200.

Figure 4:
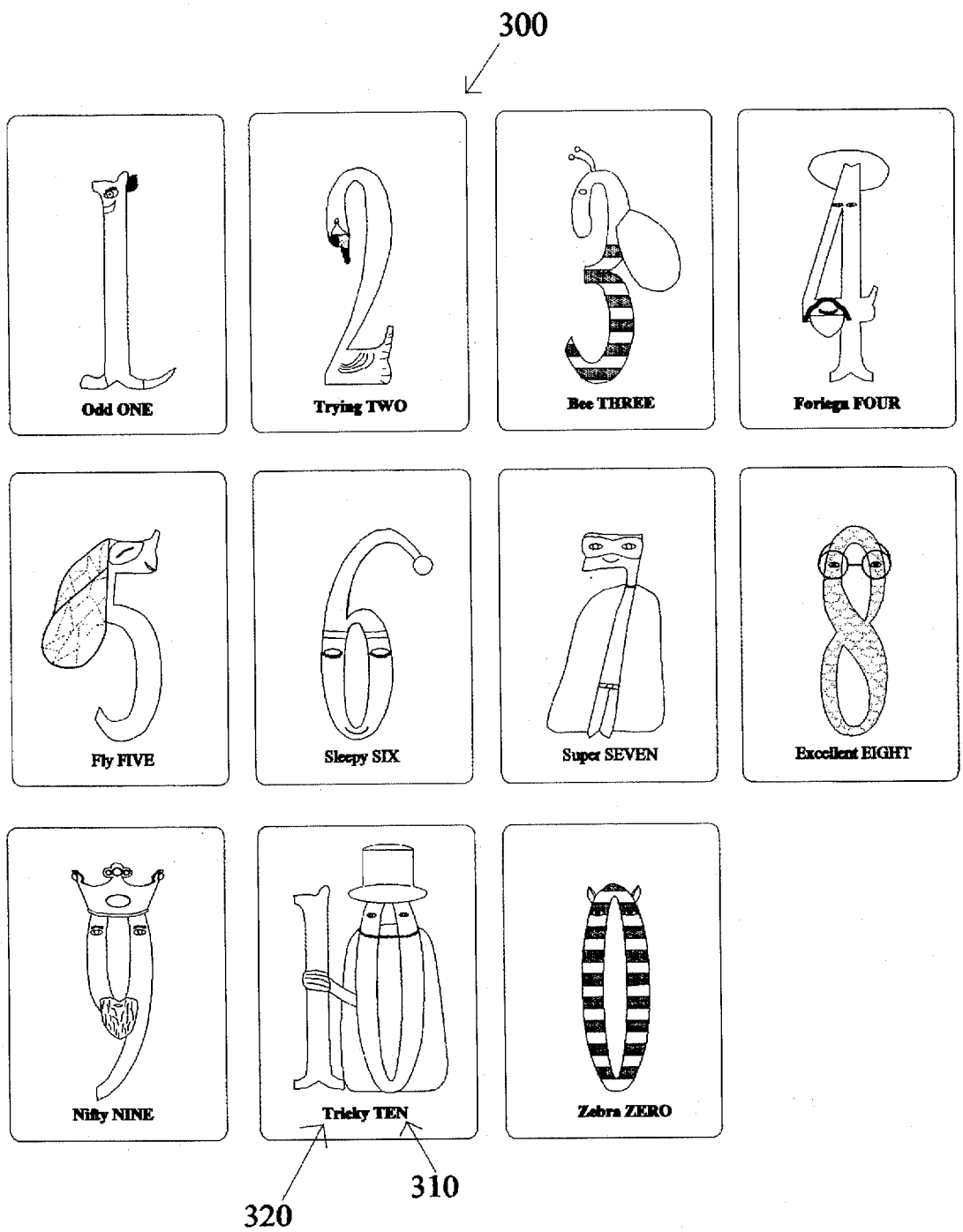
FIG. 4 is a rear view of answer cards showing various forms of numerical answers found thereon.

A deck of answer cards 300, responsive to question cards 200, is also provided for insertion into pocket 140, each answer card having numerical digits stylishly depicted thereon (FIG. 4). It is also preferred that each digit have its name spelled out, e.g. 310, and an alliterative word, e.g. 320 associated with each digit.

Figure 5:
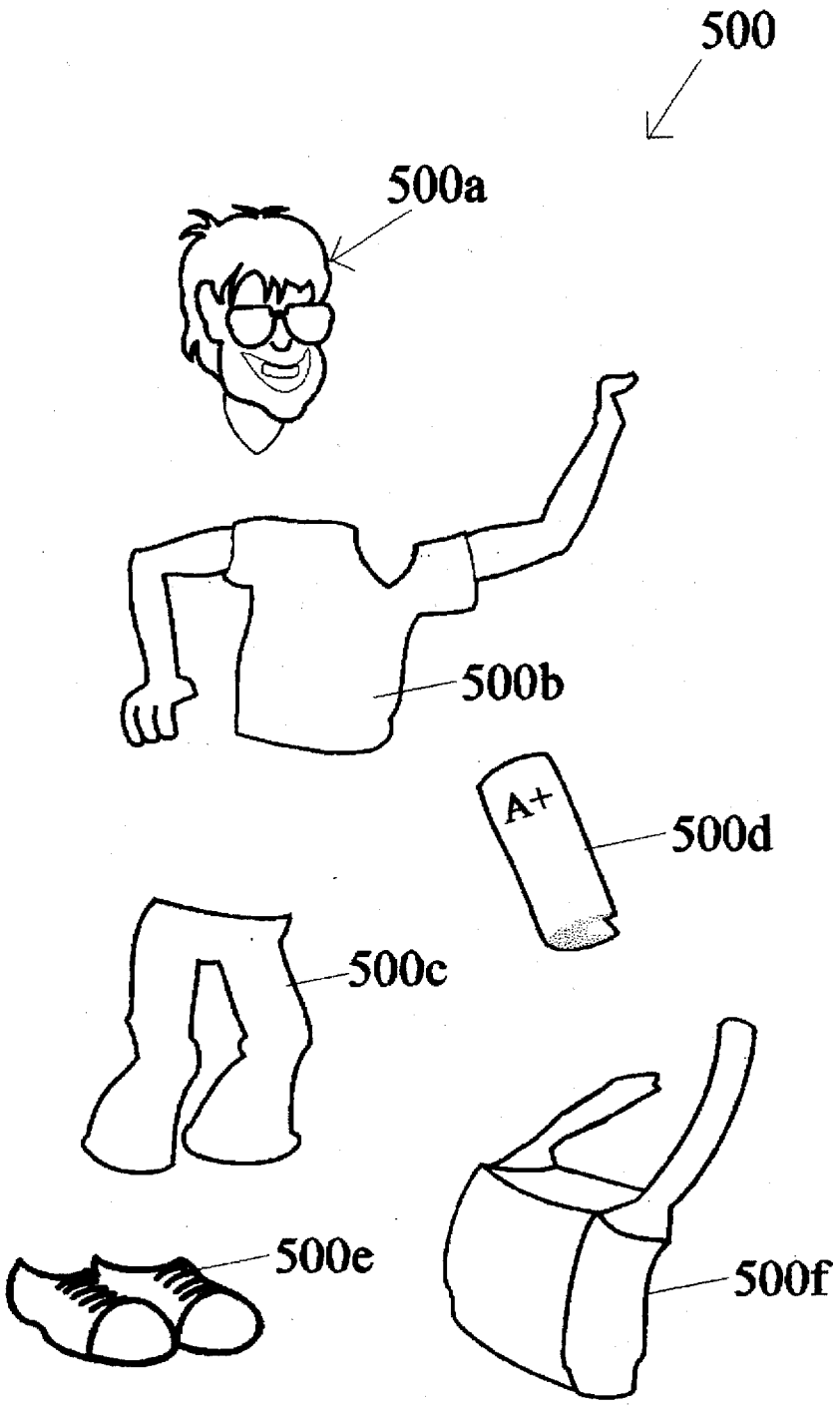
FIG. 5 shows a plurality of puzzle pieces for assembly into the caricature as shown in FIG. 2.

A plurality of pieces of a puzzle 500 are provided to each player (FIG. 5), these pieces upon assembly forming the FIG. 2 caricature 400 displayed on the question 200 or answer 300 cards. The puzzle pieces 500*a*–500*f*, as illustrated in FIG. 5, may be identical to the portions of the caricature 400. It is also understood that various modified designs of the puzzle pieces 500*a*–500*f* may be also utilized.

In one method of game play, a dealer will be chosen, such as by drawing the highest number from the answer card deck 300. The dealer then distributes a preselected plurality of answer cards 300 to each player, e.g. three cards. The dealer then reveals the first card from the question deck 200. If the dealer can correctly answer the mathematical question, presented by the revealed question card, by displaying an answer card found in the dealer's hand, a correct answer is declared. The dealer chooses one of the puzzle pieces 500*a*–500*f* from his own puzzle piece pile to begin assembly of the caricature 400. The answer card is then discarded by the dealer for subsequent reshuffling into deck 300.

If no correct answer card is revealed by the dealer, the dealer draws a card from the answer card deck 300 and relinquishes his/her turn to the next player. If the next player can answer the revealed question card with an answer card found in that player's hand, then that answer card is revealed and that player draws a puzzle piece from his own puzzle piece pile to begin assembly of the caricature 400 as well as another answer card. If no answer card can be revealed by any player in a round, a subsequent question card is then revealed and the above procedure is repeated.

If a question is answered incorrectly by any player a puzzle piece is disassembled from that player's partially assembled puzzle pieces, if any, it being understood that a player may accrue a negative puzzle piece count. Any player may challenge a player's revealed answer card. If the challenger is correct the challenger then selects a puzzle piece. If not, the challenged player may select a puzzle piece. A master plan is provided to confirm the answers to all questions posed in the question card deck 200. The first player to complete the puzzle 500 is the winner.

In an alternative method, a question card 200 is first revealed after each player has been dealt the preselected plurality of cards (3). Any player may then quickly reveal a current answer card from his hand. The first player so revealing a correct answer card wins a puzzle piece and draws an additional card. If no answer card can be revealed, each player draws a card from the answer card deck and a subsequent question card is revealed. The above alternative method is then repeated.

Players in this alternative method will be rewarded for quick and accurate thinking with a puzzle piece for each correct card revelation and correct challenges to incorrect answers, it being understood that the first person to complete the puzzle 500 is declared the winner.

It is herein understood that the difficulty of the question cards 200 can be varied according to the skill level of the player at which the game is to be directed. Thus, the questions may vary according to addition, multiplication and division skills, as well as recognition of other mathematical principles. Also, the method of game play may be reversed so as to deal the question cards 200 to the players with the answer cards 300 then being sequentially revealed.

It is also understood that puzzle pieces 500*a*–500*f* assigned to each player may have the same configuration but may have a different visual display thereon so as to present modifications of the overall assembled caricature. For example, the piece corresponding to the head 500*a* may have different faces thereon among the players. Thus, each player may select a puzzle piece from either his own puzzle piece pile or may select pieces from the other player's puzzle pile so as to assemble a puzzle which will be a variation of the basic caricature 400.

Accordingly, it is understood that the combination of the question and answer cards along with the associated puzzle presents a card and puzzle game which can be played according to different rules so as to enhance the player's mathematical skills. The game apparatus can be modified so as to teach other skills if so desired.

It is to be understood that while certain forms of this invention have been illustrated and/or described, it is not limited thereto except insofar as such limitations are included in the following claims and allowable functional equivalents thereof.

Having thus described the invention, what is claimed as new and desired to be secured by Letters Patent is as follows:

1. A method of playing a mathematical game comprising the steps of:

a. providing a first plurality of cards, each card having on one side thereof a mathematical question, said plurality of cards forming a question card deck;

b. providing a plurality of cards having on one side thereof an answer to each question posed in said question card deck;

c. providing each player a plurality of disassembled puzzle pieces of a puzzle;

d. providing each player a selected number of answer cards;

e. revealing a question card from said question card deck to initiate a round of game play;

f. a first player upon revealing an answer card responsive to said question card in said round being awarded a piece of said puzzle for assembly, said player drawing an additional answer card;

g. if no answer card is revealed in a round of game play, each player drawing an additional card from said answer card deck;

h. repeating said steps of e–g until a player first assembles said puzzle.

2. The method as claimed in claim 1 further comprising the step of providing a playing surface for said method, said game surface configured to present a pair of pants with first and second pockets, said first pocket containing said answer cards with said second pocket containing said question cards.

3. The method as claimed in claim 1 wherein said puzzle forms a caricature, said caricature displayed on one side of said question or answer cards.

4. The method as claimed in claim 1 wherein said answer on said answer cards comprises a number.

5. The method as claimed in claim 4 further comprising text on said answer cards identifying said number.

6. The method as claimed in claim 5 further comprising alliterative text associated with said text identifying said number.

7. The method as claimed in claim 1 further comprising the step of a player revealing an answer card non-responsive to said question being penalized for said incorrect revelation.

8. The method as claimed in claim 7 wherein said penalizing step comprises a puzzle piece being disassembled from a player's assembled puzzle.

9. The method as claimed in claim 1 wherein said puzzle pieces are interchangeable among said puzzles provided to each game player.

10. A method of playing a mathematical game comprising the steps of:

a. providing a first plurality of cards, each card having on one side thereof a question, said plurality of cards forming a question card deck;

b. providing a plurality of cards having on one side thereof an answer to each question posed in said question card deck;

c. providing each player a plurality of disassembled puzzle pieces of a puzzle;

d. providing each player a selected number of answer cards;

e. revealing a question card from said question card deck to initiate a round of game play;

f. a first player upon revealing an answer card responsive to said question card in said round being awarded a piece of said puzzle for assembly, said player drawing an additional answer card;

g. if no answer card is revealed in a round of game play, each player drawing an additional card from said answer card deck;

h. repeating said steps of e–g until a player first assembles said puzzle.

11. The method as claimed in claim 10 wherein said puzzle forms a caricature, said caricature displayed on one side of said question or answer cards.

12. The method as claimed in claim 10 further comprising a step of a puzzle piece being disassembled from a player's puzzle upon said player revealing an answer card non-responsive to said question card.

13. The method as claimed in claim 10 wherein said puzzle pieces are interchangeable among the puzzles provided to each game player.

14. A method of playing a mathematical game comprising the steps of:

a. providing a first plurality of cards, each card having on one side thereof a question, said plurality of cards forming a question card deck;

b. providing a plurality of cards having on one side thereof an answer to each question posed in said question card deck, said answer cards forming an answer card deck;

c. providing each player a plurality of disassembled puzzle pieces of a puzzle;

d. providing each player a selected number of cards from one of said card decks to form a playing hand;

e. revealing a card from said other card deck not utilized in step d to initiate a round of game play;

f. a first player upon revealing a card from said playing hand responsive to said revealed card in said round being awarded a piece of said puzzle for assembly, said player drawing an additional card from said deck of step d;

g. if no responsive card is revealed in said round, each player drawing an additional card from said card deck of step d;

h. repeating said steps of e–g until a player first assembles said puzzle.

15. The method as claimed in claim 14 wherein said deck of step d is said answer card deck.

16. The method as claimed in claim 14 wherein said deck of step d is a question card deck.

17. The method as claimed in claim 14 wherein said puzzle forms a caricature, said caricature displayed on one side of said question or answer card decks.

18. The method as claimed in claim 14 wherein said question is a mathematical question.

19. The method as claimed in claim 14 further comprising the step of a player revealing a card in step f non-responsive to said revealed card of step e being penalized for said incorrect revelation.

20. The method as claimed in claim 19 wherein said penalizing step comprises a puzzle piece being disassembled from a player's assembled puzzle.

* * * * *